United States Patent [19]

Mountney et al.

[11] 4,226,079

[45] Oct. 7, 1980

[54] HEATHER YARN MADE BY COMBINING POLYESTER AND POLYAMIDE YARNS

[75] Inventors: Bruce D. Mountney; Ralph C. Wirsig, both of Kingston, Canada

[73] Assignee: Du Pont Canada Inc., Montreal, Canada

[21] Appl. No.: 30,709

[22] Filed: Apr. 16, 1979

[30] Foreign Application Priority Data

May 4, 1978 [GB] United Kingdom ..... 17857/78

[51] Int. Cl.[3] ..... D02G 3/02; D02J 1/22

[52] U.S. Cl. ..... 57/288; 57/289

[58] Field of Search ..... 57/244, 245, 284, 287, 57/288, 289, 290, 350, 351, DIG. 908

[56] References Cited

U.S. PATENT DOCUMENTS

| | | | |
|---|---|---|---|
| 3,460,336 | 8/1969 | Collingwood et al. | 57/245 |
| 3,691,750 | 9/1972 | Waters | 57/290 X |
| 3,921,382 | 11/1975 | Tsujita | 57/284 X |
| 4,060,970 | 12/1977 | Talbot | 57/289 X |

*Primary Examiner*—Donald Watkins

[57] ABSTRACT

A continuous process is disclosed for producing a heather yarn from a continuous filament polyester feed yarn having a residual draw ratio in the range of from 1.6 to 2.0 and a continuous filament polyamide feed yarn having a residual draw ratio in the range of from 106 to 120 percent of the residual draw ratio of the polyester feed yarn. The process involves the steps of: (1) combining the yarns; (2) false twist texturing and drawing the combined yarns in a draw-texturing zone comprising feed rolls, a heating means, a friction twisting element and draw rolls; (3) randomly entangling the combined and textured yarns together in a jet-intermingling zone formed by an air jet device; and (4) withdrawing the heather yarn so produced.

8 Claims, 1 Drawing Figure

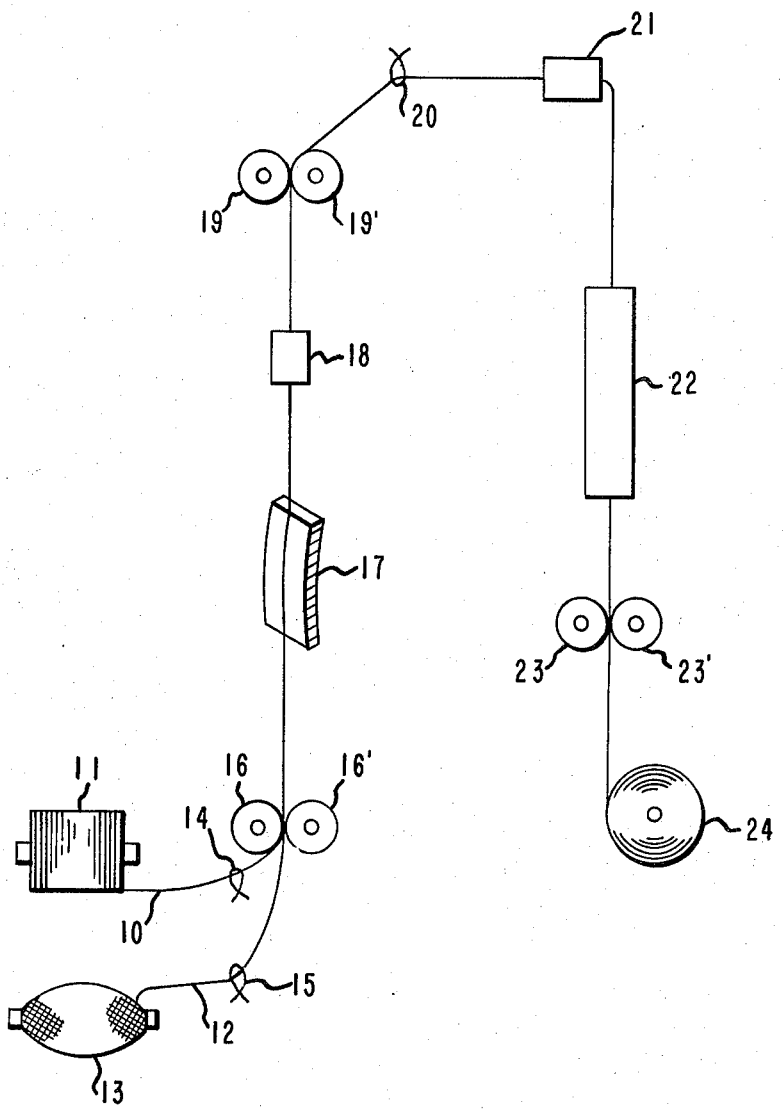
21
20
19
19'
18
22
17
23
23'
11
16
16'
14
24
10
15
12
13

HEATHER YARN MADE BY COMBINING POLYESTER AND POLYAMIDE YARNS

BACKGROUND OF THE INVENTION

This invention relates to a continuous process for making heather yarn by combining polyester and polyamide continuous filament yarns, followed by false twist texturing and drawing the combined yarns in a false twist texturing and drawing zone and then by intermingling the textured yarns in an air jet-intermingling zone.

Continuous filament heather yarns, which are yarns consisting either of a plurality of continuous filaments of different colours and/or of different dye receptivities so that they are capable of being dyed to different colours, are known in the prior art. The combining of polyester and polyamide yarns to obtain such different dye receptivities in heather yarns is also known. South African Patent Publication No. 73/3977 to Price and Hucklin, laid open for inspection May 29, 1974, discloses a process wherein continuous filament heather yarn is made by both drawing and stuffer box crimping component polyester and polyamide yarn together, followed by two separate intermingling steps. In the first intermingling step, the filaments are intermingled within each yarn, and in the second intermingling step the two intermingled yarns are brought together for entanglement with one another.

A process for making heather yarn by both drawing and jet bulking combined polyester and polyamide yarns followed by one or more intermingling steps is also known in the prior art.

Heretofore, processes for making continuous filament heather yarns in which both polyester and polyamide yarns are false twist textured have involved false twist texturing and drawing the polyester and the polyamide yarns separately, followed by twisting the yarns together to form the completed heather yarn. Such two stage processes in which the polyester and polyamide yarns are false twist textured separately have the disadvantages of requiring additional equipment and of tending to be relatively expensive.

It has now been found that the above disadvantages may be overcome and a process for making heather yarn, by both drawing and false twist texturing combined continuous filament polyester and polyamide yarns, followed by intermingling of the false twist textured yarns in a jet-intermingling zone, may be carried out provided that the polyester yarn fed to the process is a feed yarn having a residual draw ratio in the range of from 1.6 to 2.0 and that the polyamide yarn fed to the process is a feed yarn having a residual draw ratio in the range of from 106 to 120 percent of the residual draw ratio of the polyester feed yarn.

The term residual draw ratio as used herein means the draw ratio required to draw a given partially oriented continuous filament yarn to the conventional break elongation for said yarn after having been draw-textured in a conventional false twist draw-texturing process. For such a draw-textured polyester yarn made from poly(ethylene terephthalate) the conventional break elongation is about 20 percent and for such a draw-textured polyamide yarn made from poly(hexamethylene adipamide) the conventional break elongation is about 35 percent.

SUMMARY OF THE INVENTION

Accordingly the present invention provides a continuous process for producing heather yarn comprising the steps of combining a continuous filament polyester feed yarn having a residual draw ratio in the range of from 1.6 to 2.0 with a continuous filament polyamide feed yarn having a residual draw ratio in the range of from 106 to 120 percent of the residual draw ratio of the polyester feed yarn, feeding the combined yarns to a draw-texturing zone, false twist texturing and drawing the combined yarns in the draw-texturing zone at a draw ratio equal to 95 to 105 percent of the residual draw ratio of the polyester feed yarn, feeding the combined yarns from the draw-texturing zone to a jet-intermingling zone, randomly entangling the combined yarns together in the jet-intermingling zone and withdrawing the heather yarn.

In an embodiment of the process of the present invention, the combined yarns are drawn in the draw-texturing zone at a draw ratio substantially equal to the residual draw ratio of the polyester feed yarn.

Another embodiment of the process of the present invention includes the step of feeding the combined yarns from the jet-intermingling zone to a heating zone in order to heat set the combined yarns prior to withdrawing the heather yarn.

In yet another embodiment of the process of the present invention, the heather yarn is withdrawn from the heating zone at a speed in the range of from 6 to 17 percent slower than the speed at which the combined yarns are fed to the jet-intermingling zone.

In yet another embodiment of the process of the present invention the polyester feed yarn has a residual draw ratio in the range of from 1.7 to 1.9 and the polyamide feed yarn has a residual draw ratio in the range of from 110 to 117 percent of the residual draw ratio of the polyester feed yarn.

In a further embodiment of the process of the present invention the polyester feed yarn has a residual draw ratio of 1.65 and the polyamide feed yarn has a residual draw ratio of 1.86.

In a still further embodiment of the process of the present invention the polyester feed yarn is made from poly(ethylene terephthalate) and the polyamide feed yarn is made from poly(hexamethylene adipamide).

In a still further embodiment, the residual draw ratio of the polyamide feed yarn is 104 to 118 percent of the residual draw ratio of the polyester feed yarn, and the combined yarns are drawn at a draw ratio equivalent to at least 95 percent of the residual draw ratio of the polyester feed yarn.

In the process of the present invention, the polyester feed yarn should have a residual draw ratio in the range of from 1.6 to 2.0. Moreover, in order to achieve process stability and satisfactory texturing of both the polyester feed yarn and the polyamide feed yarn in the draw-texturing zone, it is important that the polyamide feed yarn have a residual draw ratio that is somewhat greater than that of the polyester feed yarn. Preferably the polyamide feed yarn should have a residual draw ratio in the range of from 110 to 117 percent of the residual draw ratio of the polyester feed yarn. If, for example, the polyamide feed yarn has a residual draw ratio equal to or less than that of the polyester feed yarn, the polyamide yarn tends to migrate to the centre (form a core) and the polyester yarn tends to wrap around the polyamide yarn in helical coils when the two yarns are fed to the draw-texturing zone. This leads to process instability and uneven yarn. If, on the other hand, the polyamide feed yarn has a residual draw ratio which is too much greater than, e.g. is greater than 120 percent of, that of the polyester feed yarn, the polyester yarn tends to migrate to the centre (form a core) and the polyamide yarn tends to wrap around the polyester yarn in helical coils when the two yarns are fed to the draw-texturing zone. This also leads to process instability and uneven yarn. For example, in a case where the polyester feed yarn had a residual draw ratio of 1.65 and the polyamide feed yarn had a residual draw ratio of 2.88 i.e. 174 percent of that of the polyester feed yarn, the process was shown to be very unstable and the yarn produced therefrom was shown to be very slubby and to have severe tight spots. Canadian Pat. No. 971,439 to G. T. Waters, issued July 22, 1975 discloses producing core yarns by feeding two undrawn filamentary yarns having differing values of extension under a given stress to a combined drawing and false twist crimping process. In this prior art process, the yarn having the greater extensibility forms a helical wrapping around a false twist textured core of the other yarn.

BRIEF DESCRIPTION OF THE DRAWING

The drawing is a schematic representation of the process of the invention.

DETAILED DESCRIPTION OF THE ILLUSTRATED EMBODIMENT

One embodiment of the process of the present invention will be described with reference to the drawing. Multifilament polyester feed yarn 10 is pulled from a supply package 11 and multifilament polyamide feed yarn 12 is pulled from supply package 13 over pigtail guides 14 and 15 respectively, by a pair of feed rolls 16 and 16'. Polyester feed yarn 10 is a spun oriented or partially drawn yarn having a residual draw ratio in the range of from 1.6 to 2.0. Polyamide feed yarn 12 is a spun oriented or partially drawn yarn having a residual draw ratio in the range of from 106 to 120 percent of the residual draw ratio of the polyester feed yarn. Partially drawn polyamide feed yarn may be produced on a drawtwister or a spin draw machine or it may be produced sequentially just prior to the process of the present invention e.g. by adding an additional pair of feed rolls. From the feed rolls 16 and 16' the combined yarns pass to a draw-texturing zone comprising a heater plate 17, a friction twisting element 18 and draw rolls 19 and 19'. On leaving feed rolls 16 and 16' the yarns enter a section of increasing twist gradient due to the insertion of twist into the yarns by friction twisting element 18. The twist gradient reaches a maximum value on heater plate 17. The draw rolls 19 and 19' operate at a higher speed than feed rolls 16 and 16' to draw the yarns (on heater plate 17) at a draw ratio equal to 95 to 105 percent of the residual draw ratio of polyester feed yarn 10.

The post friction head tension of the combined yarns was monitored by measuring between friction twisting element 18 and draw rolls 19 and 19'. The range over which this post friction head tension varies is important because the range gives an indication of the texturing process stability, a narrower tension range indicating greater process stability.

From draw rolls 19 and 19' the yarns pass through pigtail guide 20 to a jet-intermingling zone formed by air jet device 21. The yarns then pass through secondary (non-contact) heater 22, between take up rolls 23 and 23' and are finally wound up on package 24.

Suitable machines for carrying out the false twist texturing and drawing step in the draw texturing zone are, for example, a Leesona false twist texturing machine of a type shown in U.S. Pat. No. 3,292,354 issued Dec. 20, 1966 to Chalfant et al; or the Scragg Super-Draw-Set® II (SDS II), available from Ernest Scragg and Sons, Macclesfield, England. In the false twist texturing and drawing step, the temperature of contact heater 17 is at a conventional temperature above 180° C., usually about 200° C.

Air jet device 21 randomly entangles the filaments of the polyester yarn with the filaments of the polyamide yarn such that fabric produced from the resulting heather yarn is free of large streaks and colour blotches. A suitable air jet device 21, is for example, an air jet device in accordance with FIGS. 2 through 5 of U.S. Pat. No. 3,971,108, issued July 27, 1976 to A. A. Gorrafa, angle C in FIG. 3 thereof being 80°.

In the secondary heater 22, the false twist textured and jet-intermingled yarns are heat set at a temperature above 190° C., usually about 215° C. It will be appreciated that if heat setting of the yarns is not desired secondary heater 22 may be omitted.

In the process of the invention, the jet-intermingling step may be carried out just before the yarns are wound up on package 24. For example the air jet device 21 may be positioned downstream of the take up rolls 23 and 23' instead of being positioned as shown in the drawing. With this latter arrangement, however, the intermingling of polyester filaments with polyamide filaments is not as complete because the tension on the yarns entering air jet device 21 is higher with air jet device 21 in the latter position than it is with the air jet device 21 in the position shown in the drawing. It is well known in the art that air jet devices function more efficiently at low inlet yarn tension.

The present invention is illustrated by the following examples.

EXAMPLE I

A 189 dtex-34 filament polyester feed yarn and an 84 dtex-13 filament polyamide feed yarn were combined, co-false twist draw-textured in a false twist draw-texturing zone, randomly entangled together in a jet-intermingling zone and wound up on a package. The polyester feed yarn had been spun from molten poly(ethylene terephthalate) and wound up at a speed of 3110 meters/-min and hence was partially oriented (drawn), having a residual draw ratio as hereinbefore defined of 1.65. The polyamide feed yarn had been produced from 130 dtex-13 filament yarn which had been spun from molten poly(hexamethylene adipamide) and which is conventionally used at a draw ratio of 2.88 to make 45 dtex-13 filament textured yarn. The polyamide feed yarn had been drawn at a draw ratio of 1.55 to produce a feed yarn with a residual draw ratio of $$\frac{2.88}{1.55} = 1.86.$$

The polyamide feed yarn thus had a residual draw ratio equal to $$\frac{1.86}{1.65} \times 100 = 113$$

percent of that of the polyester feed yarn. The apparatus used to false twist draw-texture, jet-intermingle and wind up the combined yarns was similar to that shown in the drawing and described hereinbefore. The machine used for carrying out the false twist draw-texturing step was a Scragg-Super-Draw-Set II (SDS II) machine, available from Ernest Scragg and Sons, Macclesfield, England. A standard disc friction twister was used on the Scragg SDS II. The feed rate of feed yarns 10 and 12 from feed rolls 16 and 16' was 192 meters/-min. Heater plate 17 had a length of 101 cm and was operated at a temperature of 200° C. Disc friction twister 18 (having a diameter of 50 mm) was operated at a speed of 3310 r/min. The post friction head tension range of the combined yarns was measured between the friction twister 18 and draw rolls 19 and 19' and was 8 grams. Draw rolls 19 and 19' were operated at a speed of 317 meters/min to give a draw ratio of 1.65. By operating at this draw ratio all of the residual draw ratio of the polyester feed yarn 10 was removed; and $$\frac{1.65}{1.86} \times 100 = 89$$

percent of the residual draw ratio of the polyamide feed yarn 12 was removed. Air jet device 21 was operated with an air pressure of 531 kPa (60 psig). Secondary (non-contact) heater 22 had a length of 100 cm and was operated at a temperature of 215° C. Take up rolls 23 and 23' were operated at a speed of 281 meters/min, which was 13 percent lower than the speed at which the combined yarns were fed to the jet-intermingling zone of air jet device 21. The heather yarn was wound up on package 24 at a speed of 295 meters/min. The heather yarn was knit on a Dubied ® A-24 weave knit machine (French pique stitch). After dyeing the knitted product was observed to have a very good "salt and pepper" effect and was considered to be of commercial quality.

EXAMPLE II

A 216 dtex-34 filament polyester feed yarn and a 96 dtex-13 filament polyamide feed yarn were combined, co-false twist draw-textured in a false twist -draw-texturing zone, randomly entangled together in a jet-intermingling zone and wound up on a package. The polyester feed yarn had been spun from molten poly(ethylene terephthalate) and wound up at a speed of 2835 meters/-min and hence was partially oriented (drawn), having a residual draw ratio of 1.89. The polyamide feed yarn had been produced from 130 dtex-13 filament yarn which had been spun from molten poly(hexamethylene adipamide) and which is conventionally used at a draw ratio of 2.88 to make 45 dtex-13 filament textured yarn. The polyamide feed yarn had been drawn at a draw ratio of 1.35 to produce a feed yarn with a residual draw ratio of $$\frac{2.88}{1.35} = 2.13.$$

The polyamide feed yarn thus had a residual draw ratio equal to $$\frac{2.13}{1.89} \times 100 = 113$$

percent of that of the polyester feed yarn. The apparatus used in this example was the same as that used in EXAMPLE I. The feed rate of feed yarns 10 and 12 from feed rolls 16 and 16' was 168 meters/min. Heater plate 17 was operated at a temperature of 200° C. Disc friction twister 18 was operated at a speed of 3310 r/min. Draw rolls 19 and 19' were operated at a speed of 317 meters/min to give a draw ratio of 1.89. By operating at this draw ratio all of the residual draw ratio of the polyester yarn was removed; and $$\frac{1.89}{2.10} \times 100 = 89$$

percent of the residual draw ratio of the polyamide feed yarn was removed. Air jet device 21 was operated with an air pressure of 531 kPa (60 psig). Secondary (non-contact) heater 22 was operated at a temperature of 215° C. Take up rolls 23 and 23' were operated at a speed of 281 meters/min, which was 13 percent lower than the speed at which the combined yarns were fed to the jet-intermingling zone of air jet device 21. The heather yarn was wound up on package 24 at a speed of 295 meters/min.

EXAMPLE III

For comparative purposes, a number of tests were run similar to EXAMPLE I and with the same polyester feed yarn, but with polyamide feed yarns having different residual draw ratios, one of which was outside the range 106—120% of the residual draw ratio of the polyester feed yarn. In each test the post friction head tension range of the combined yarns was measured as described in EXAMPLE I. The results are summarized below in the Table, which also includes the result of EXAMPLE I.

TABLE

| Test | Residual Draw Ratio (RDR) Polyester | Residual Draw Ratio (RDR) Polymide | % RDR Polymide of RDR Polyester | Post Friction Head Tension Range |
|---|---|---|---|---|
| A | 1.65 | 1.93 | 117 | 10 |
| Example I | 1.65 | 1.86 | 113 | 8 |
| B | 1.65 | 1.81 | 110 | 11 |
| C | 1.65 | 1.72 | 104 | 18 |

Test C was outside the present invention. As indicated by the higher post friction head tension range, the texturing stability for Test C was significantly worse than that for Tests A and B and EXAMPLE I.

We claim:

1. A continuous process for producing heather yarn comprising the steps of combining a continuous filament polyester feed yarn having a residual draw ratio in the range of from 1.6 to 2.0 with a continuous filament polyamide feed yarn having a residual draw ratio in the range of from 106 to 120 percent of the residual draw ratio of the polyester feed yarn, feeding the combined yarns to a draw-texturing zone, false twist texturing and drawing the combined yarns in the draw-texturing zone at a draw ratio equivalent to 95 to 105 percent of the residual draw ratio of the polyester feed yarn, feeding the combined yarns from the draw-texturing zone to a jet-intermingling zone, randomly entangling the combined yarns together in the jet-intermingling zone and withdrawing the heather yarn.

2. The process according to claim 1 in which the combined yarns are drawn in the draw-texturing zone at a draw ratio substantially equal to the residual draw ratio of the polyester feed yarn.

3. The process according to claim 2 including the step of feeding the combined yarns from the jet intermingling zone to a heating zone in order to heat set the combined yarns prior to withdrawing the heather yarn.

4. The process according to claim 3 in which the heather yarn is withdrawn from heating zone at a speed in the range of from 6 to 17 percent slower than the speed at which the combined yarns are fed to the jet-intermingling zone.

5. The process according to claim 1 in which the polyester feed yarn has a residual draw ratio in the range of from 1.7 to 1.9 and the polyamide feed yarn has a residual draw ratio in the range of from 110 to 117 percent of the residual draw ratio of the polyester feed yarn.

6. The process according to claim 5 in which the polyester feed yarn has a residual draw ratio of 1.65 and the polyamide feed yarn has a residual draw ratio of 1.86.

7. The process according to any one of claim 1, claim 3 and claim 6 in which the polyester feed yarn is made from poly(ethylene terephthalate) and the polyamide feed yarn is made from poly(hexamethylene adipamide).

8. The process according to claim 1, except that the residual draw ratio of the polyamide feed yarn is 104 to 118 percent of the residual draw ratio of the polyester feed yarn, and that the combined yarns are drawn at a draw ratio equivalent to at least 95 percent of the residual draw ratio of the polyester feed yarn.

* * * * *